US006568875B1

(12) United States Patent
Paulshus et al.

(10) Patent No.: US 6,568,875 B1
(45) Date of Patent: May 27, 2003

(54) CONNECTOR INTENDED FOR USE WITH TENSION LEG PLATFORM

(75) Inventors: Bjørn Paulshus, Skedsmokorset (NO); Willy Bjerke, Lørenskog (NO); Morten Rengman Mørck, Oslo (NO)

(73) Assignee: Kvaerner Oilfield Products AS, Lysaker (NO)

( * ) Notice: Subject to any disclaimer, the term of this patent is extended or adjusted under 35 U.S.C. 154(b) by 0 days.

(21) Appl. No.: 09/763,002

(22) PCT Filed: Aug. 10, 1999

(86) PCT No.: PCT/NO99/00249

§ 371 (c)(1),
(2), (4) Date: Mar. 12, 2001

(87) PCT Pub. No.: WO00/09389

PCT Pub. Date: Feb. 24, 2000

(30) Foreign Application Priority Data

Aug. 13, 1998 (NO) ..... 19983710

(51) Int. Cl.[7] ..... E21B 33/035

(52) U.S. Cl. ..... 403/321; 403/322.1; 166/350; 166/365; 405/223.1; 405/224

(58) Field of Search ..... 166/365, 350, 166/367, 242.6; 405/223.1, 224, 202, 227, 224.2, 224.3, 224.4; 403/321, 322.1, 3, 330

(56) References Cited

U.S. PATENT DOCUMENTS 4,439,055 A * 3/1984 Quigg et al. ..... 403/330
4,459,931 A * 7/1984 Glidden ..... 114/230
4,459,933 A * 7/1984 Burchett ..... 114/297
4,611,953 A * 9/1986 Owens ..... 405/224
4,664,558 A * 5/1987 De Meio et al. ..... 405/224
4,854,777 A * 8/1989 Lemoine et al. ..... 405/202
4,869,615 A * 9/1989 Galle ..... 403/11
5,273,376 A * 12/1993 Ritter, Jr. ..... 405/169

FOREIGN PATENT DOCUMENTS

| | | |
|---|---|---|
| EP | 0 334 464 A2 | 9/1989 |
| GB | 2033463 A | 5/1980 |
| GB | 2182709 A | 5/1987 |
| GB | 2 201 709 A | 9/1988 |

* cited by examiner

*Primary Examiner*—Anthony Knight
*Assistant Examiner*—Michael P. Ferguson
(74) *Attorney, Agent, or Firm*—Knobbe, Martens, Olson & Bear, LLP

(57) ABSTRACT

A connector in particular intended for use with a tension leg platform is disclosed. The connector comprises a male part (1) and a female part (2), which male part (1) is designed to engage in the female part (2) and the parts are able to engage with one another without any of the parts having to rotate in respect of the other. The female part (2) comprises an abutment ring having an internal continuous downward facing abutment shoulder (4) and the male part (1) has a discontinuous segmented ring (5). Each individual ring segment (8) is limitary independantly movable, both axially and radially, which segmented ring (5) lies slidably against a mandrel abutment (9).

23 Claims, 3 Drawing Sheets

CONNECTOR INTENDED FOR USE WITH TENSION LEG PLATFORM

BACKGROUND OF THE INVENTION

1. Field of the Invention

The present invention relates to a connector, in particular intended for use on a tension leg platform, comprising a male part and a female part, in which the male part is intended for entering in the female part and are able to make engagement with each other without the need for any of the parts to rotate in respect of the other.

2. Description of the Related Art

During exploration of oil and gas resources in deep waters, tension leg platforms, or TLP, are more frequently used. Such a platform comprises a floating installation moored to the seabed by means of vertical mooring stays called tension legs. These tension legs do substantially suppress three of the six degrees of freedom of a floating vessel. A tension leg platform can not heave, pitch or roll, but can surge, sway and yaw. Tension legs feature connectors, located at the bottom and top of each tension leg. The connectors have to transmit the mooring loads in the tension legs while permitting an angular motion in relation with surging, swaying and yawing.

The present invention is directed toward a new design of the bottom connector part of the tension leg that connects the tension leg to a connector part in a base structure on the seabed.

The functions of such a bottom connector are that angular motion is allowed, the connector is able to transmit the mooring forces to the sea bed base structure, and the connector is not permanently connected to the tension leg.

A number of designs for this type of bottom connector are previously known. One design requires that the entire tension leg needs to be rotated in order to engage a locking mechanism in the connector.

An early version of a bottom connector design made use of a system having spring biased collect fingers requiring that the tension leg, be landed on the bottom of the sea bed connector having a predetermined load in order to activate the locking mechanism.

A design recently utilised in the North Sea requires no locking mechanism when the bottom connector is entered into the base structure on the sea bed by means of lateral entrance by a slot in the side wall of the load supporting structure.

One design that is often used in the Mexican Gulf is a variant of the concept comprising the rotatable lock. This design, however, does not require that the entire tension leg be rotated. The male part of the connector has a rotatable ring that is rotated in that the male part is lowered into the female part of the connector and then elevated. The female part has a system with lugs and slots, which carries the locking mechanism into correct orientation. A lowering and elevating the male part of the connector a second time rotates system again, allowing disconnections.

SUMMARY OF THE INVENTION

The present invention improves the existing designs by enabling a vertical entering and eliminates at the same time the need to rotate the tension leg or any part thereof. Further, the need of a vertical locking force is avoided. Also the need for a system having slots and lugs on the internal wall of the female part is ceased.

The male part may be entered vertically into the female part. The male part locks to the female part automatically when it is entered. The connector does not need to be rotated in order to engage properly. The locking is performed by means of the net weight of the tension leg. When the male part is in engagement in the female part, the connector can only be disconnected again by use of external tools. Thus the design becomes fail-safe since, when it is loaded or strained, the locking can not be released.

In a preferred embodiment, the connector comprises a female part and a male part. The female part comprises an abutment ring having a continuously downward facing internal abutment shoulder; the male part has a discontinuous segmented ring, wherein each individual ring segment is independently movable, both axially and radially. The segmented ring lies slideably against a mandrel.

Further, the upper portion of the female part may have a funnel form for axial and radially inward guiding of the segmented ring on the male part during the entering thereof into the female part. Advantageously the abutment shoulder can also be bevelled downwards and outwardly to form a wedge surface. The male part may include an entering portion that is tapered downwardly for entering into the female part. Further, each segment may remain in loose connection with a continuous annular body via guiding bolts or stays. The mandrel on the male part can be tapered upwardly, or conical, and form a wedge surface. Each segment may have an outwardly facing surface which corresponds with the downwardly facing surface of the abutment shoulder, and an inwardly facing surface which corresponds with the abutment surface of the mandrel, said two segment surfaces converging upwardly in order to form a wedge.

BRIEF DESCRIPTION OF THE DRAWINGS

Other objects, features and advantages of the invention will appear from the following description of a preferred embodiment of the invention, which is disclosed in the appended drawings where.

DETAILED DESCRIPTION OF THE PREFERRED EMBODIMENTS

Figure 1:
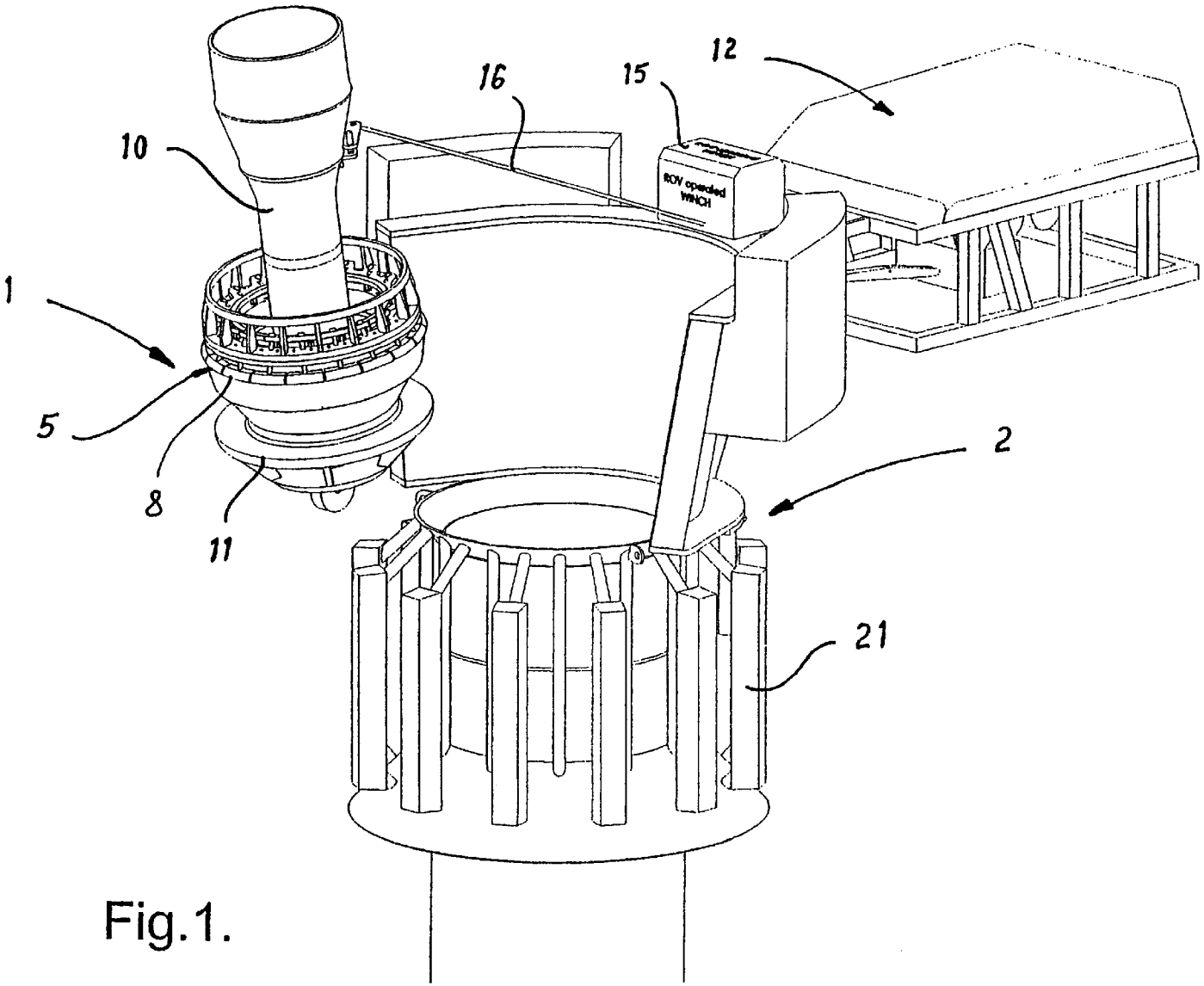
FIG. 1 shows in perspective view the bottom connector part of the tension leg at the moment the connector part is brought over a base structure set down on the sea bed by means of a tool and a ROV operated winch provided on the tool, the base structure comprises a second connector part.

FIG. 1 illustrates a situation in which the lower part 1 of a tension leg 10 is about to be entered into a seabed anchored connector part 2, which constitute the female part of the connector. The part having reference number 1 constitute the male part. Together they constitute a connector for connecting a tension leg of a tension leg platform to a sea bed anchor, or base structure, either in form of a stake or suction anchor. The male part can, as in the shown embodiment, comprise a tapered entering part 11 in order to ease the entering of the male part 1 into the female part 2. In order to assist during the entering process, a tool 12 is stationary fixed to the female part 2. The tool 12 comprises a ROV operated winch 15 that is in connection with the bottom part of the tension leg 10 via a pulling line 16. In FIG. 1 is a series of offer anodes 21 arranged circumferentially around the female part 2. These shall prevent corrosion of the female part for a long time and have, per se little to do with the invention proper.

Figure 2:
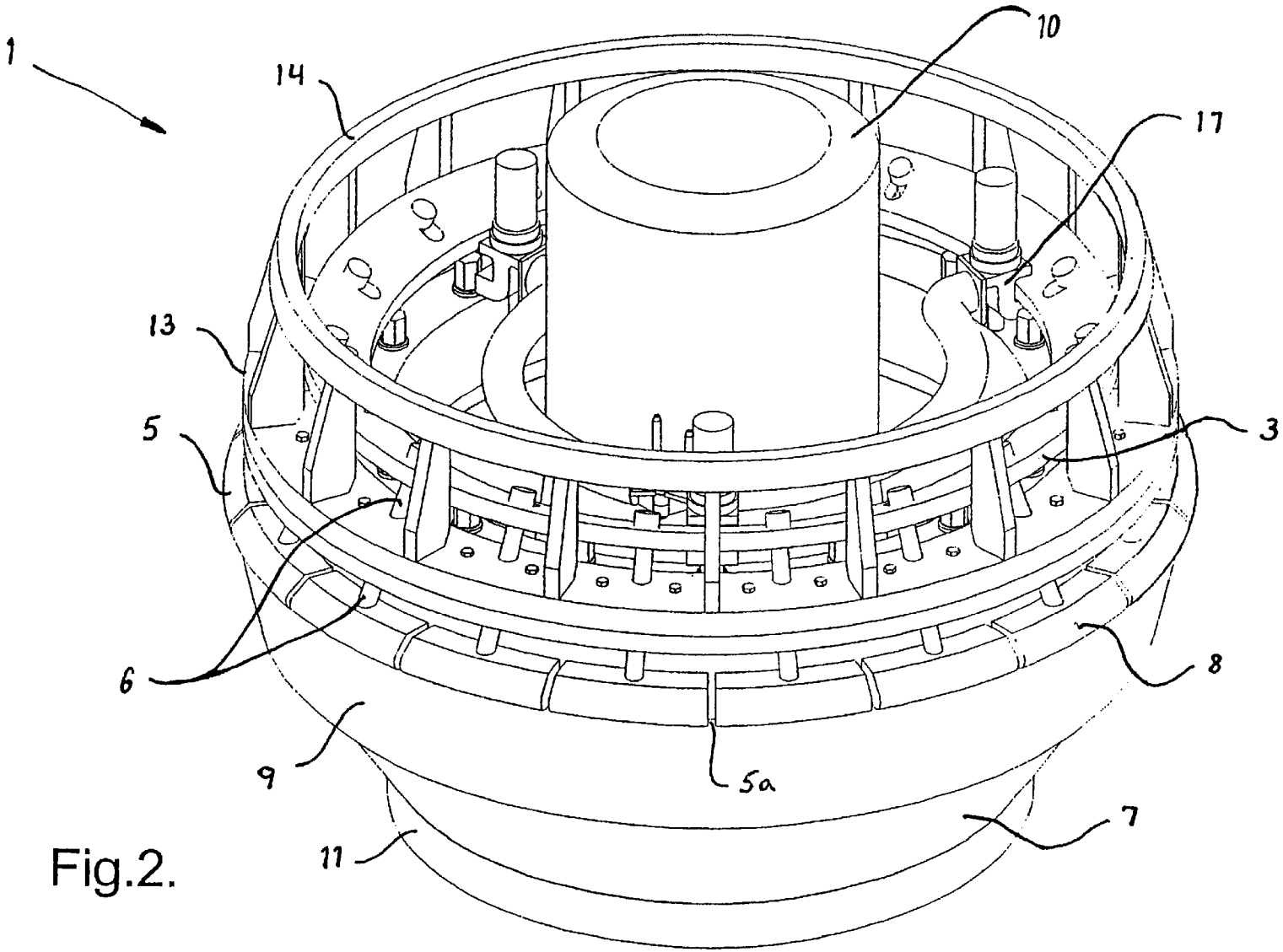
FIG. 2 shows in perspective view and in closer detail the bottom connector part of the tension leg.

FIG. 2 shows the male part 1 of the connector in closer detail. The connector is attached to the bottom part of the tension leg 10 and includes a segmented ring where each single ring segment 8 is limitary independently movable, both axially and radially. The segmented ring 5; or each individual segment per se, is lying slidably against a mandrel 9. In the bottom of the FIG. 2 is a minor part of the entering mandrel 11 shown and the entering mandrel 11 is connected to the mandrel 9 via a flexible element 7. Each individual segment 8 is in connection with an elevating ring 3 via guiding bolts or stays 6. Each guiding bolt 6 has its lower end threadingly fixed, or in any other suitable way attached to the segment 8 .The upper end of the bolt 6 is loosely attached only to the elevating ring 3. Thus, the segments 8 have a certain, but limited freedom of motion. The guiding bolts 6 are further passed through apertures in a ring structure 13 that is provided with an annular fence 14. It is moreover arranged for later placement of a release tool 17 that can be landed onto the male part 1 as shown in the figure, when the time has come for disconnecting or releasing the male part 1 of the connector from the female part 2 thereof. The release tool 17 is able to engage the elevating ring 3 and raise the ring 3 upward together with the guiding bolts 6 and the individual segments 8. This can, however, only happen when the tension leg is completely relieved and entered some distance into the female part 2.

Figure 3:
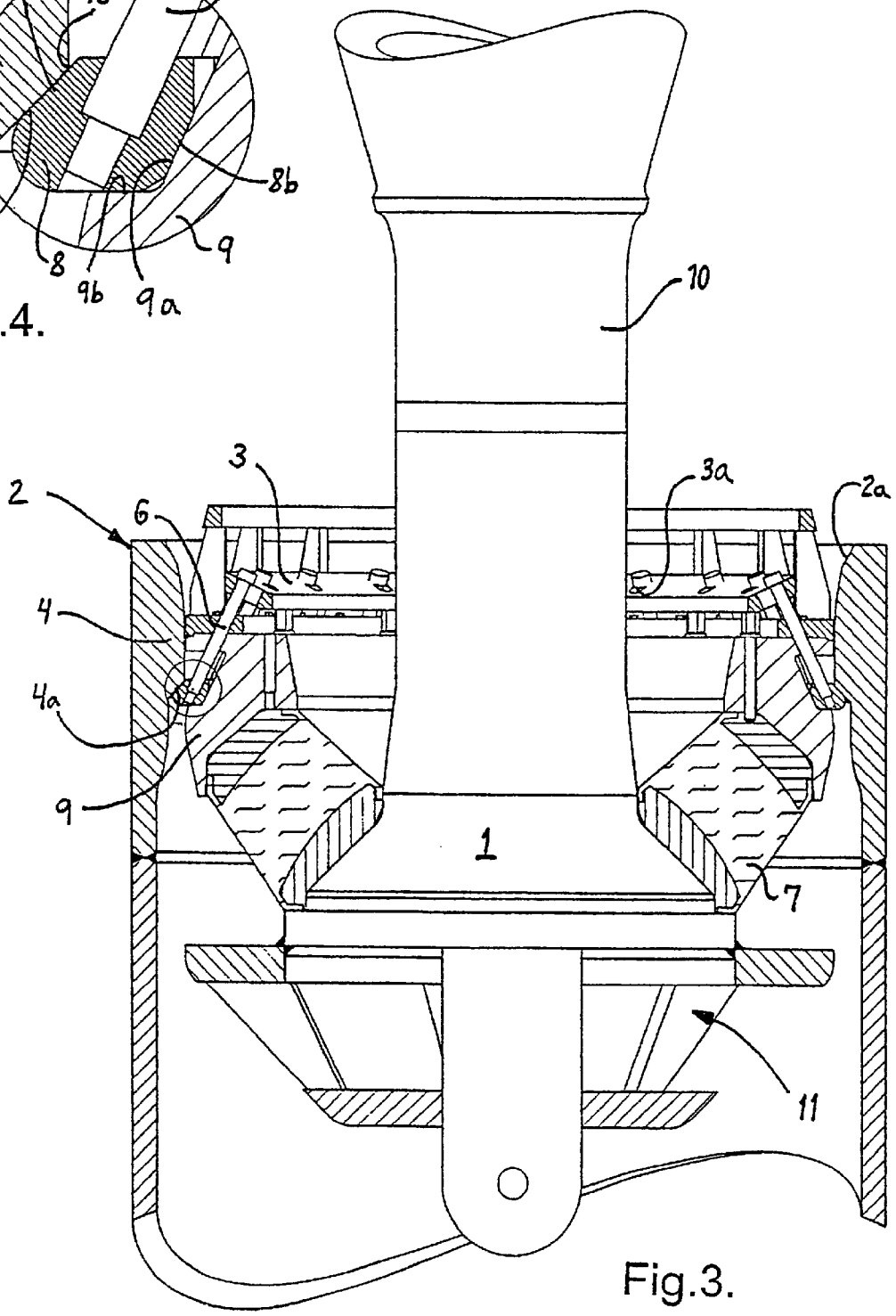
FIG. 3 shows the connector in engaged state such that the tension leg is in fixed connection with the base structure on the sea bed.

FIG. 3 shows the female part 2 in cross section and the male part 1 entered into and in engagement with the female part 2. As it appears from the figure, the female part 2 includes a shoulder 4 having a downwardly facing abutment surface 4*a*. in the drawing the tension leg 10 is illustrated in a substantially vertical position. It is, however, to be understood that the tension leg 10 is able to adopt up to several degrees of angular deviation in respect of a vertical line by aid of the elastomeric element 7 that is able to occupy such angular deviations.

Figure 4:
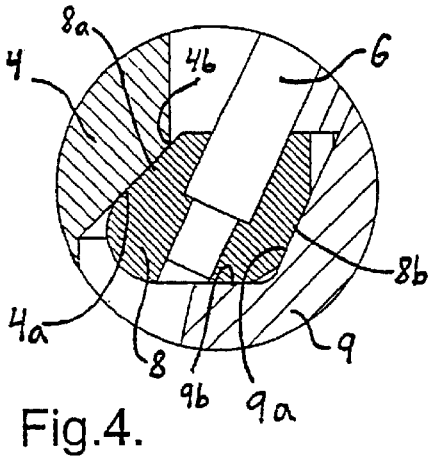
FIG. 4 shows the circumscribed part of FIG. 3 in closer detail and shows the locking system.

FIG. 4 shows the circumscribed portion of FIG. 3 in closer detail. The shoulder 4 of the female part 2 has a downwardly directed and sloping abutment surface 4*a*. The mandrel 9 has an upwardly directed and sloping abutment surface 9*a*. Correspondingly the segments 8 have an upwardly facing and sloping surface 8*a* that is intended for engagement against the abutment surface 4*a* of the shoulder 4. The internal surface 8*b* of each segment 8 is directed inwardly and downwardly and is intended to abut with the outwardly and upwardly directed surface 9*a* on the mandrel 9. The surfaces 8*a* and 8*b* are converging towards each other corresponding to the surfaces 4*a* and 9*a* and form a type of wedge faces. The bolt 6 is also shown threaded into the segment 8. The abutment shoulder 4 of the female part 2 is a continuous shoulder, in contradiction to what has been common where the shoulder has had discontinuities in order to enable entering of the male part. The continuous shoulder 4 provides great axial and radial strength and simultaneously this provides for a plain and smooth internal surface of the female part 2.

The lower most part of the tension leg 10 can be welded to the leg or be joined by other suitable mechanical means. The flexible, elastomeric element 7 is preferably constructed of rubber and steel embedded in the rubber, and is threaded to the tension leg and facilitates a sort of spherical motion of the leg 10 in respect of the other components. The mandrel 9 and the abutment surfaces thereof are threadably fixed to the flexible, elastomeric element 7 and transmits the loads to the locking mechanism proper in the form of the ring segment 5 with associated components. Each and all of the above mentioned are load supporting components.

As stated there are a number of segments 8, which form a segmented ring 5, assembled to the mandrel 9 around the outer diameter thereof. The segments 8 abut the tapered or conical surface 9*a* of the mandrel 9 and are provided with a ledge 9*b* at the bottom of the conical surface 9*a*.

The normal, locked position of the segments 8 is at the bottom of the conical surface 9*a* having the weight of the segments 8 resting on the ledge surface 9*b*. In this lower position do the segments 8 project beyond the largest diameter of the male part 1 such that the segments 8 make engagement with the internal shoulder 4 against the abutment. The continuous abutment ring 4 increases the strength ratio substantially. In this way the segments 8 get clamped between the mandrel 9 and the shoulder 4. When the leg 10 is tensioned, the load is transmitted from the mandrel 9, through the segments 8 and to the abutment ring 4. The continuous abutment ring 4 increases the strength ratio substantially.

The design thus becomes fail safe because as long as the connector is under load, the segments 8 are not releasable.

The segments 8 are also able to adopt an elevated position at the top of the conical surface 8*b*. In this position the segments 8 are lying within the outer diameter of the male part 1 and are able to pass through the smallest diameter of the female part 2, i.e., the shoulder 4. The segments 8 can be brought to elevated position on one of two possible ways. When the male part 1 is lowered into the female part 2, the segments 8, which rest naturally in their lower position do contact the upper surface 2*a* of the shoulder 4 and the segments 8 are pushed upwardly. When the segments 8 are pushed upwardly, the segments follow the conical surface 9*a* on the mandrel 9 and are guided by the stay or bolt 6 that is fixed to each segment 8, and pass through a sleeve having loose attachment, in order to adopt their upper position and thus pass through the shoulder 4.

In an alternative embodiment, a tool 17 engages a continuous elevation ring 3 mounted underneath the heads of the bolts 6 described above. The ring 3 is elevated by the tool 17 and when this is done, the bolt 6 elevates the segments 8 that are attached thereto. The ring 3 is kept in the elevated position so that the segments 8 remain in the released position allowing the male part 1 to be lifted out of the female part 2. In order to be able to accomplish this operation, the connector needs to be relieved, i.e. the tension leg has to be relieved from all tensioning load.

In the first operating mode the segments 8 are free to move independently, while in the second mode the segments are forced to move in unison. In the first mode the segments 8 are free to fall back into the engagement position as soon as the segments have passed the edge 4*b* of the abutment 4, which instantly facilitate snap locking of the connector.

The segments 8 are load carrying elements. The guiding bolts 6 and the elevation ring 3 are not load carrying elements.

Even though the segments 8 apparently form a nearly continuous ring 5 around the outer diameter of the male part 1, a gap 5*a* does exist between each individual segment 8 when the segments 8 are in the lower, locked position. This is necessary so that the segments 8 are retractable to the upper position without interfering with each other.

The guiding bolts 6 and the sleeve are of such length that it provides for sufficient guiding for the segment 8 such that sticking of the mechanism is avoided in cases where a segment 8 is pushed upwards by one corner only and not evenly over the entire surface thereof.

The guiding bolts 6 are inclined in respect to the longitudinal axis of the male part 1 and substantially at the same inclination as the cone angle of the conical surface 9*a* that controls the segments 8.

The elevation ring 3 has oversized apertures 3*a* which bolts 6 pass through. These oversized apertures 3*a* serve two functions. Firstly, when the ring 3 is elevated and lifts the guiding bolts 6 and the segments 8, the relative radial position of the bolts 6 and the ring 3 is altered due to the inclination of the guiding bolts 6. In order to absorb this, the apertures 3 are slotted, i.e. oblong in the radial direction. Secondly, in order to allow that the elevation ring 3 can be elevated during some strain, the apertures 3 are enlarged tangentially so that the elevation ring 3 at the same time can be completely elevated at one side and be completely lowered at the other side without pinching or getting the mechanism stuck. In order to ensure even contact between the bolt head and the elevation ring 3, the shoulder of the bolt head has a spherical profile and the upper surface of the elevation ring 3 has a profile that mates with the profile of the bolt head.

The release of the male part 1 from the female part 2 is achieved by use of the previously mentioned and thereto intended release tool 17.

The release tool 17 is deployed in the male part 1 by a remote operated submerged vehicle, a so-called ROV. The male part 1 is kept under load against the shoulder 4 on the female part 2. The facilitates the operation to install the tool 17 since the female part 2 is not in motion. The release tool 17 utilises a spring loaded mechanism, either a mechanical spring or a hydraulic spring, which uses a jacking-accumulator system. The tool 17 is installed and the spring activated. When the male part 1 is in engagement with the shoulder 4, the segments 8 are not able to move the elevation ring 3 can not be elevated and the connector parts remain in engagement with each other.

When the release tool 17 is installed and activated, the axially acting load on the male part 1 can be relieved and the part lowered from the engagement position with the shoulder 4. As soon as the contact of the segments 8 and shoulder 3 ceases, the spring loaded tool elevates the elevation ring 3, which again lifts the segments 8 to their upper released position. The male part 1 can now be pulled out of the female part 2.

In order to re-establish the male part 1 so that the part once more engages the female part 2, it will be sufficient to remove the release tool 17, which allows that the elevation ring 3 and the segments 8 fall down by their own weight. The connector is then in its initial position and can once more become interlocked, or snap locked, into the female part 2 of the connector.

What is claimed is:

1. A connector for use in a tension leg platform, comprising:

a female portion comprising an abutment ring having an internally continuous abutment shoulder, a male portion comprising a mandrel with a continuous ring body having a plurality of radially slotted apertures, and a plurality of independently movable locking segments lying slideably against said mandrel to form a discontinous segmented ring wherein each of said plurality of locking segments lies against said mandrel in a first radial position along a ledge, and wherein said locking segments are independently displaced axially and radially sliding along said mandrel from said first radial position when said male portion is first joined with said female portion and wherein each of said locking segments freely slide back into said first radial position after said male portion is joined and substantially aligned with said female portion such that said locking segments are positioned between said ledge and said abutment shoulder.

2. The connector of claim 1 wherein said female portion has a funnel configuration for axial and radial guiding of said segmented ring.

3. The connector of claim 1 wherein said abutment shoulder is beveled, forming a wedge surface.

4. The connector of claim 1, wherein a portion of said male portion is tapered downwardly, for entering said female portion.

5. The connector of claim 1 wherein said locking segments are loosely connected to the continuous ring body via a stay.

6. The connector of claim 1 wherein said locking segments are loosely connected to the continuous ring body via a guiding bolt.

7. The connector of claim 1 wherein said mandrel is tapered upwardly, forming a wedge surface.

8. The connector of claim 1, wherein said locking segments comprise an outwardly facing surface and an inwardly facing surface, said outwardly facing surface corresponding with a surface of said abutment shoulder, said inwardly facing surface corresponding with a surface of said mandrel.

9. The connector of claim 1, wherein said abutment surface is horizontal.

10. A connecting device for use in a tension leg platform, the device comprising:

a female part having an abutment shoulder; and a male part having a mandrel, a continuous ring body, and a plurality of locking segments lying slidably against said mandrel, wherein said plurality of locking segments are loosely connected to said continuous ring body via a guiding bolt in a manner that said locking segments are independently moveable both axially and radially sliding along said mandrel from said first radial position when said male portion is first joined with said female portion and wherein each of said locking segments freely slide back into said first radial position after said male portion is joined and substantially aligned with said female portion.

11. The device of claim 10, wherein said female part further comprises an abutment ring, and wherein the abutment ring comprises said abutment shoulder.

12. The device of claim 11, wherein said abutment shoulder comprises an internally continuous abutment shoulder.

13. The device of claim 10 wherein said locking segments comprise a discontinuous segmented ring, said ring having individual ring segments, and wherein said locking segments engage said abutment shoulder.

14. The device of claim 10, wherein said abutment shoulder is beveled, forming a wedge surface.

15. The device of claim 10 wherein at least a portion of said male part is tapered downwardly for the purpose of entering said female part.

16. The device of claim 10, wherein said female part comprises a funnel configuration for guiding of said segmented ring.

17. The device of claim 10, wherein said mandrel is tapered upwardly, forming a wedge surface.

18. The device of claim 10 wherein said locking segments comprise an outwardly facing surface and an inwardly facing surface, said outwardly facing surface corresponding with a surface of said abutment shoulder, said inwardly facing surface corresponding with a surface of said mandrel.

19. The device of claim 18 wherein said surface of said abutment shoulder is horizontal.

20. The connector of claim 1 wherein when said locking segments are positioned between said ledge and said abutment shoulder said female portion becomes locked with said male portion.

21. The connector of claim 20 wherein said female portion becomes locked with said male portion via the locking segments when said female portion and said male portion are put under tension.

22. The connector of claim 1 wherein said locking segments are simultaneously displaced axially and radially when a first central axis of said male portion is substantially aligned with respect to a second central axis of said female portion upon joining.

23. The connector of claim 1 wherein said locking segments are individually displaced axially and radially when a first central axis of said male portion is partially inclined with respect to a second central axis of said female portion upon joining.

* * * * *